United States Patent [19]
Wu et al.
[11] 4,197,997
[45] Apr. 15, 1980

[54] FLOATING RING FUEL INJECTOR VALVE

[75] Inventors: Hai Wu, Northville; Walter K. Heintz, Westland, both of Mich.

[73] Assignee: Ford Motor Company, Dearborn, Mich.

[21] Appl. No.: 929,142

[22] Filed: Jul. 28, 1978

[51] Int. Cl.[2] ..... B05B 1/08
[52] U.S. Cl. ..... 239/102; 239/453; 239/533.12; 239/554
[58] Field of Search ..... 239/101, 102, 453, 456, 239/459, 533.2-533.12, 554

[56] References Cited

U.S. PATENT DOCUMENTS

| | | | |
|---|---|---|---|
| 1,198,537 | 9/1916 | Guy | 239/456 X |
| 2,235,365 | 3/1941 | Grumbt . | |
| 3,031,492 | 1/1967 | Kingsley | 239/535 |
| 3,039,699 | 6/1962 | Allen | 239/102 X |
| 3,069,099 | 12/1962 | Graham | 239/533.12 X |
| 3,938,552 | 2/1976 | Rosenberg | 239/101 X |

*Primary Examiner*—Robert W. Saifer
*Attorney, Agent, or Firm*—Steven L. Permut; Keith L. Zerschling

[57] ABSTRACT

A fuel injector valve has a nozzle housing with a bore therethrough having an outlet end in communication with a cylinder of an internal combustion engine. The bore has a seating surface at its lower end which seats an annular ring. The annular ring has a central aperture therethrough with a seating surface at its lower open end. The aperture receives a plunger sized to leave a space between the edges of the aperture and the plunger surface. The plunger has a flanged lower section and is spring biased upwardly to have the flanged lower section contact the seating surface of the ring. The upward biasing force also forces the ring to abut the seating surface of the nozzle housing. The fluid under pressure enters the nozzle housing and forces the plunger and annular ring downward. Fluid passes through the passage between the floating ring and nozzle housing and also between a second passage between the floating ring and plunger so that a spray pattern with a cross-section of two concentric rings is formed entering the engine cylinder.

6 Claims, 6 Drawing Figures

FIG. 1.
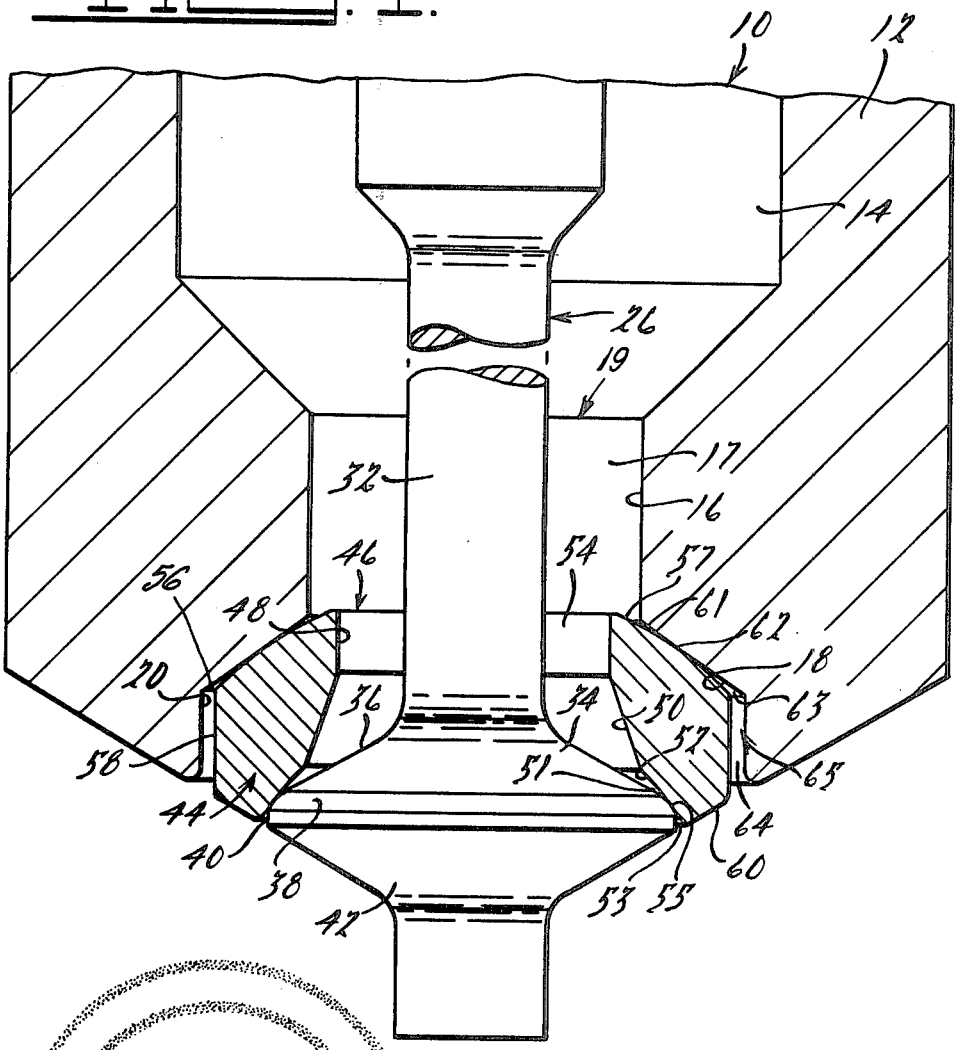
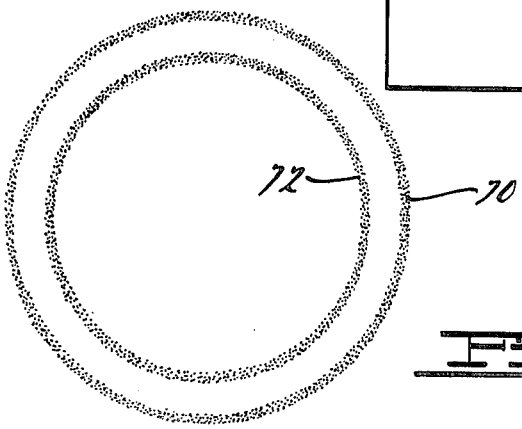
FIG. 3.

FLOATING RING FUEL INJECTOR VALVE

BACKGROUND OF THE INVENTION

1. Field of the Invention

This invention relates to combustion engines.

2. Description of the Prior Art

Many nozzles have been developed to spray fuel directly into a cylinder of an internal combustion engine. The valves of the nozzle not only must spray fine spray evenly dispersed over a large space of the cylinder but also must close upon compression of the vapors within the cylinder by the engine piston. In order to create a fine spray evenly dispersed in the cylinder, nozzles have been devised with a plurality of ports. One such valve is disclosed in U.S. Pat. No. 2,235,365 issued to Grumbt on Mar. 18, 1941. The Grumbt patent disclosed a fuel injection valve having a needle nozzle seated within a bore of the nozzle housing. Fluid passes between the annular clearance between the needle nozzle and the nozzle housing. The nozzle also has ports passing therethrough which provide a second passage for the fuel spray.

Another patent which discloses an annular cross-sectional spray pattern is U.S. Pat. No. 3,301,492 issued to Kingsley on Jan. 31, 1967. Kingsley discloses a stem fitted within a bore of the nozzle housing. The lower end of the stem is contoured with the open and conforming with the sloped sides of the nozzle housing to outwardly direct spray therefrom into a conical shaped spray pattern with a circular cross-sectional area. The spray is controlled by a spring biased member with a central aperture which receives the stem which is spring biased upwardly to abut the contoured end of the stem to close off the passage between the stem and aperture of the spring biased member. Pressure exerted by the fuel pump downwardly presses the spring biased member to open the passage to allow the spray to enter the cylinder.

SUMMARY OF THE INVENTION

According to the invention, a fuel injector valve has a nozzle housing with the bore extending therethrough. The nozzle housing has a seat portion at its lower end which receives a float member.

In one embodiment, the seat portion of the nozzle housing is a frustoconical surface sloped downward and radially extending outwardly from the central axis of the bore.

The float member is moveable to a position away from the seat to form a first annular passage between the nozzle housing and float member. The float member has a front surface sensitive to fluid pressure exerted thereon to move the annular ring away from its seated position to open the first passage.

In one embodiment, the portion of the float member which abuts the nozzle housing seat is a convex annular surface. In one embodiment the frustoconical seat portion makes contact with the convex surface of the float member, along a circular path centered about the axis of the nozzle housing bore.

The float member also has a central aperture therethrough. The aperture has a lower seating portion. Preferably, the aperture has a circular cross-section and the seating portion is a radially and downwardly extending surface. In one embodiment the aperture seat portion is a concave annular surface extending downward and radially outward. Preferably the concave annular surface is concentric to the convex annular surface of the floating member.

A plunger member is general cyclindrical in shape and extends through the nozzle housing bore and the aperture of the floating ring member. The radial dimensions of the plunger are such that there is clearance between the plunger aperture and bore. The plunger has a flanged portion radially extending embodiment, the outer periphery of the flange portion has an annular convex surface having a radius which is smaller than the radius of the annular concave portion of the float member, so that the plunger makes contact with the concave seating portion of the float member along a circular path centered about the longitudinal axis of the nozzle bore. In one embodiment, the path of contact between the float member and nozzle housing is located vertically aligned over the path of contact between the float member and flange section of the plunger.

The plunger is moveable to a position where the flanged section becomes unseated from the seating surface of the float member forming a second annular passage therebetween. The float member has a second surface sensitive to fluid pressure exerted thereon which biases the float member away from its seated position with the plunger thereby opening the second annular passage. Biasing means bias the plunger toward the nozzle housing seat to wedge the float member between the plunger and the nozzle housing seat closing off the passage between the nozzle housing and float member and the second passage between the plunger and float member. The biasing means is sensitive to fluid pressure within the bore such that when fluid pressure is great enough, the plunger extends away from the nozzle housing seat allowing the float member to be unseated from both the nozzle housing seat and flanged portion of the plunger to allow fluid to pass through the first and second passages.

In one embodiment, the fluid pressure on the first surface biases the float member to its seated position with respect to the plunger and fluid pressure on the second surface biases the float member to its seated position with the nozzle housing. The pressure differentials in the two passages vary inversely with the cross-sectional areas of the respective passages to vibrate the float member between its seated position with the nozzle housing and its seated position with the plunger to pulsate the sprays passing through the two annular passages.

In one preferred embodiment, the spray passing through each passage has a circular cross-sectional area.

BRIEF DESCRIPTION OF THE DRAWINGS

Reference now will be made to the following drawings in which:

FIG. 1 is a fragmentary partially segmented side elevational view of an embodiment of the invention.

FIG. 3 is a schematic plan view of the spray pattern taken along the line 3—3 shown in FIG. 2.

DETAILED DESCRIPTION OF THE PREFERRED EMBODIMENT

Figure 2:
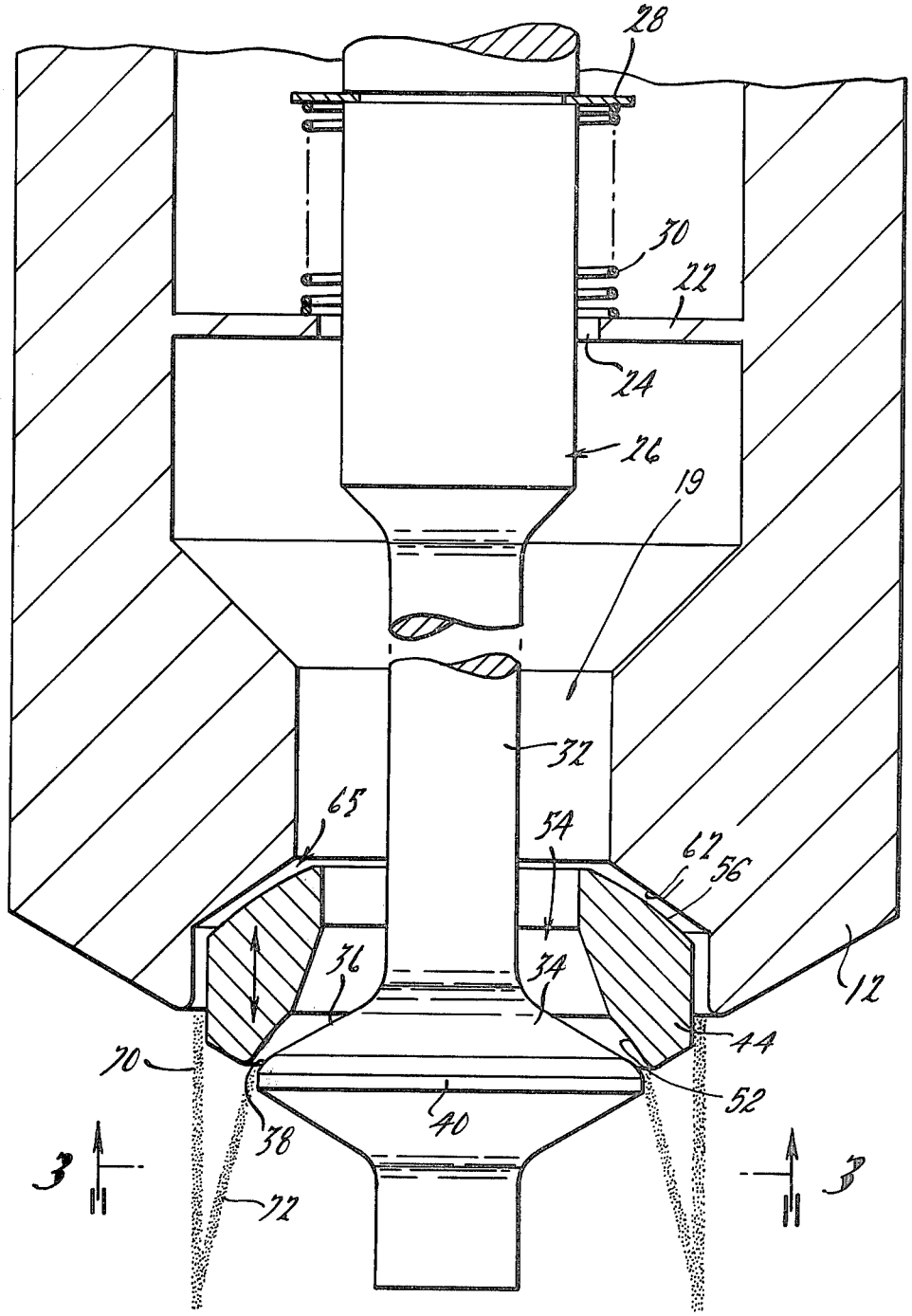
FIG. 2 is a side elevational partially segmented view of the embodiment shown in FIG. 1 with the valve in the open position.

A fuel injection valve 10 has a nozzle housing 12 with a bore 14 extending downwardly therethrough. The bore has a surface 16 forming a venturi section 19, a downward and radially outwardly extending frustoconical surface 18 and a vertical rim section 20 vertically extending downward from the outer periphery of the frustoconical surface.

As shown in FIG. 2, the space above the venturi section has a shoulder section 22 with a central aperture 24 extending therethrough.

Extending through the central aperture 24 is a plunger 26. The plunger 26 has lug mounts 28 outwardly extending therefrom. A compression spring 30 is retained between the mounts 28 and the shoulder 22 of the housing to upwardly bias the plunger. Other upward biasing systems may be used in place of the compression spring 30, lug mounts 28 and shoulder 22.

The plunger 26 has a stem portion 32 which extends through the venturi section 19 of the housing. The stem portion 32 is sized to leave a sizable gap 17 between the stem 32 and the venturi surface 16.

The bottom portion of the plunger 26 has a flange section 34 extending radially outward from the longitudinal axis of the plunger. The flange 34 has a flat frustoconical annular surface 36 and an annular convex surface 38. At the outer periphery of the convex surface 38 is a cylindrical surface 40 and a downwardly tapered section 42 extending downwardly therefrom. The cylindrical surface 40 and tapered surface 42 do not affect the function of the valve but are present merely by convenience of manufacture of the plunger member.

An annular ring member 44 has a central aperture 46. The central aperture 46 has plunger 26 extending therethrough. The central aperture 46 has a top cylindrical portion 48, a frustoconical portion 50, and a concave annular seating surface 52. The concave seating surface 52 and the frustoconical surface 50 extend radially outward from a longitudinal axis of the aperture 46. The aperture is sized to receive the stem portion 32 of plunger 26 leaving an annular passage 54 therebetween.

As long as no fuel flows into bore 14 from a fuel pump (not shown) the spring biased plunger 26 has its annular convex surface 38 abut the concave annular surface 52 of the ring along circular path 55. To achieve the one point contact, the convex surface 38 has a radius convature of which is less than the radius curvature of the surface 52. Annular gaps 51 and 53 exist between the plunger and ring on both sides of contact paths.

An annular convex surface 56 radially extends outward from the top shoulder 57 surrounding the aperture 46 to a cylindrical rim surface 58. Annular surface 56 is concentric with annular surface 52. Rim surface 58 extends downwardly to a bottom surface 60 which extends between the rim surface 58 and concave seating surface 52. The shoulder portion 57 extends inwardly from venturi surface 16. The convex surface 56 abuts the frustoconical surface 18 along a circular path at 62 as shown in FIG. 1 leaving gaps 61 and 63 between the ring and nozzle housing at both sides of the contact path 62. Circular contact path 62 is vertically aligned over circular contact path 55. The outer rim 58 is sized to leave an annular gap 64 between itself and rim 20 of housing 12. Gaps 61, 63 and 64 form a passage 65 leading from venturi 19 to the engine's cylinder (not shown).

In operation, when the fuel pump (not shown) introduces fuel under pressure into bore 14, the pressure of the fuel acts upon the frustoconical flange portion 34 to press the plunger downward against the biasing force of the compression spring 30. In addition, the fuel pressure in passage 54 and gaps 51 opens the plunger with respect to the floating ring 44 so fuel may flow through passage 54 passing by point 55. Pressure exerted on the shoulder 57 of the convex surface 56 and within gap 61 opens passage 65 between the floating ring 44 and housing 12 so fuel may flow from venturi 19 and gap 61 passing by point 62 and into gap 64. Such a situation is illustrated in FIG. 2 with both passages 54 and 65 shown open. In addition, the pressure differential within each passage 54 and 65 varies so that the floating ring 44 vibrates between the seated position with respect to plunger 26 and its seated position with respect to housing 12. If the floating ring is seated on plunger 26, the pressure exerted at passage 54 is greater than the pressure within passage 65 so that passage 54 will be opened with an upward movement of the floating ring 44 until the floating ring is in a seated position with respect to housing 12. When the ring 44 is seated with respect to housing 12, the pressure exerted on shoulders 57 and gap 61, is greater than the pressure exerted within passage 54 so that the ring 44 will then move downward and open passage 65 until the plunger is again seated on plunger 26. In this fashion the floating ring vibrates between two positions pulsating the spray passing through the two passages 54 and 65 and breaking the fuel droplets into a fine spray.

The resulting spray pattern emerging from the nozzle is a dual annular spray pattern with an outer cylindrical spray pattern 70 and an inner conical spray pattern 72 each spray pattern 70 and 72 having a circular cross-section as illustrated in FIG. 3.

The outer spray 70 can be changed from a cylindrical spray pattern to a conical spray pattern by merely changing the slope of rim 20 to an outward angle more closely aligning the frustoconical surface 18.

The cylindrical spray pattern 70 will eventually intersect with spray pattern 72 within the cylinder of the internal combustion engine.

In this fashion, a fuel injection valve produces a fine dual annular spray in a cylinder for even dispersion of liquid fuel particles thereon for smooth combustion within the cylinder.

Reasonable variation and modification are possible within the scope of the foregoing disclosure and drawings without departing from the spirit of the invention which is defined by the appended claims.

The embodiments of the invention in which an exclusive property or privilege is claimed are defined as follows:

1. A fuel injection valve comprising:

a nozzle housing with a bore extending therethrough;

a plunger with an upper stem portion and a lower flange portion;

said flange portion radially extending outwardly and downwardly;

a float member having an aperture sized to receive the stem of the plunger;

a first passage between the stem and float member;

the float member having a seat portion which seats the flange section of the plunger closing off the first passage between the stem and float member;

the nozzle housing having a seat surface which receives the float member;

the nozzle housing seating surface being outwardly and downwardly sloped;

the float member being movable to an unseated position with respect to the nozzle housing such that a second passage is formed between the float member and nozzle housing;

means for biasing the plunger upward toward the seating surface of the nozzle housing to seat the flange portion of the plunger on the float member and to seat the float member on the nozzle housing closing off both passages;

the biasing means being sensitive to fluid pressure in the bore to allow the plunger to be lowered thereby allowing fuel to pass through both the first and second passages the float member having a first surface sensitive to the fluid pressure exerted thereon biasing the float member away from its seated position with respect to the nozzle housing and a second surface sensitive to fluid pressure exerted thereon biasing the float member away from its seated position with respect to the plunger;

the float member having an equilibrium position between the respective seated positions on the nozzle housing and plunger where the pressures exerted on the respective first and second surfaces are in equilibrium and both passages and open allowing fluid to pass therethrough.

2. A fuel injection valve as defined in claim 1 wherein the fluid pressure in the first passage exerted on the float member biases the float member to the seated position with respect to the nozzle housing and the fluid pressure in the second passage exerted on the float member biases the float member to the seated position with respect to the plunger; and the fluid pressures in each passage are variable and inversely depend on the cross-sectional area of the respective passages such that the float member vibrates between the two respective seated positions alternately closing and opening the first and second passages in rapid sequence.

3. A fuel injection valve as defined in claim 1 wherein the float member is an annular ring; the stem portion of the plunger has a cylindrical portion extending through the aperture of the annular ring; the flange portion of the plunger has a radially outwardly and downwardly sloped surface; the flange portion forms an edge of the first passage to direct the fluid passing therethrough in a radial outward and downward direction to form a frustoconical spray pattern with a ring-shaped cross-section; the bore of the nozzle housing has a circular cross-section; the annular ring and plunger are axially aligned with the longitudinal axis of the bore; the seating surface of the nozzle housing forms an edge of the second passage and directs the fluid passing therethrough in a downward direction to form a second spray pattern with a ring-shaped cross-section of initially larger diameter than the initial diameter of the cross-section of the first ring shaped pattern.

4. A fuel injection valve as defined in claim 3 wherein the seating surface of the nozzle housing extends radially outward to form a frustoconical shaped shoulder; the annular ring has an annular convex surface which when in the seated position makes contact along a circular path with the frustoconical shoulder to close the second passage; the annular ring has an annular concave surface which forms the seating surface for the flange portion of the plunger; the annular concave surface makes contact with the flange section of the plunger along a circular path.

5. A fuel injection valve as defined in claim 4 wherein the circle of contact between the plunger and annular ring and the circle of contact between the nozzle housing and the annular ring are vertically aligned.

6. A fuel injection valve as defined in claim 4 further comprising: the nozzle housing having a cylindrical surface extending downward from the outer periphery of the frustoconical surface of the nozzle housing and spaced from the outer periphery of the annular ring to form a vertical discharge portion of the second passage such that the spray exiting from the second passage is cylindrical in shape and converges with the frustoconical spray exiting from the first passage at a distance below the injection valve.

* * * * *